US005624284A

United States Patent [19]

Gib et al.

[11] Patent Number: 5,624,284

[45] Date of Patent: Apr. 29, 1997

[54] ELECTRICAL PLUG-TYPE CONNECTOR HAVING AN INTERLOCK MECHANISM

[75] Inventors: Michael Gib, Landau, Germany; Joris Dobbelaere, Beernem, Belgium

[73] Assignee: Siemens Aktiengesellschaft, Munich, Germany

[21] Appl. No.: 400,825

[22] Filed: Mar. 8, 1995

[30] Foreign Application Priority Data

Mar. 9, 1994 [DE] Germany ..... 44 07 950.8

[51] Int. Cl.[6] ..... H01R 13/514

[52] U.S. Cl. ..... 439/752; 439/748

[58] Field of Search ..... 439/752, 746, 439/747, 748, 749, 595

[56] References Cited

U.S. PATENT DOCUMENTS

| | | | |
|---|---|---|---|
| 4,583,805 | 4/1986 | Mantlik | 439/595 |
| 4,660,915 | 4/1987 | Mantlik | 439/595 |
| 5,066,252 | 11/1991 | Kafo et al. | 439/752 |
| 5,464,356 | 11/1995 | Nebeshima et al. | 439/752 |

FOREIGN PATENT DOCUMENTS

| | | |
|---|---|---|
| 3247022 | 8/1988 | Germany . |
| 4123505 | 1/1993 | Germany . |

*Primary Examiner*—Neil Abrams
*Assistant Examiner*—T. C. Patel
*Attorney, Agent, or Firm*—Hill, Steadman & Simpson

[57] ABSTRACT

An electrical plug-type connector has primary securing means formed by an interlock mechanism comprising a primary catch edge and a stationary contact wall of the housing that interact with the first catch tongue of the contact element. The opposite, second contact chamber wall is provided on a slide member that is movable at least transversely relative to the plug-in direction, but preferably also obliquely relative thereto and has a segmented catch edge having paths for the second catch tongue to pass therealong. By moving the slide, a primary and secondary secured interlock position of both catch tongues occur as a result of engagement behind the respective catch edges. This movement will also cause a forward feed of the contact element not correctly plugged in and primarily latched.

13 Claims, 6 Drawing Sheets

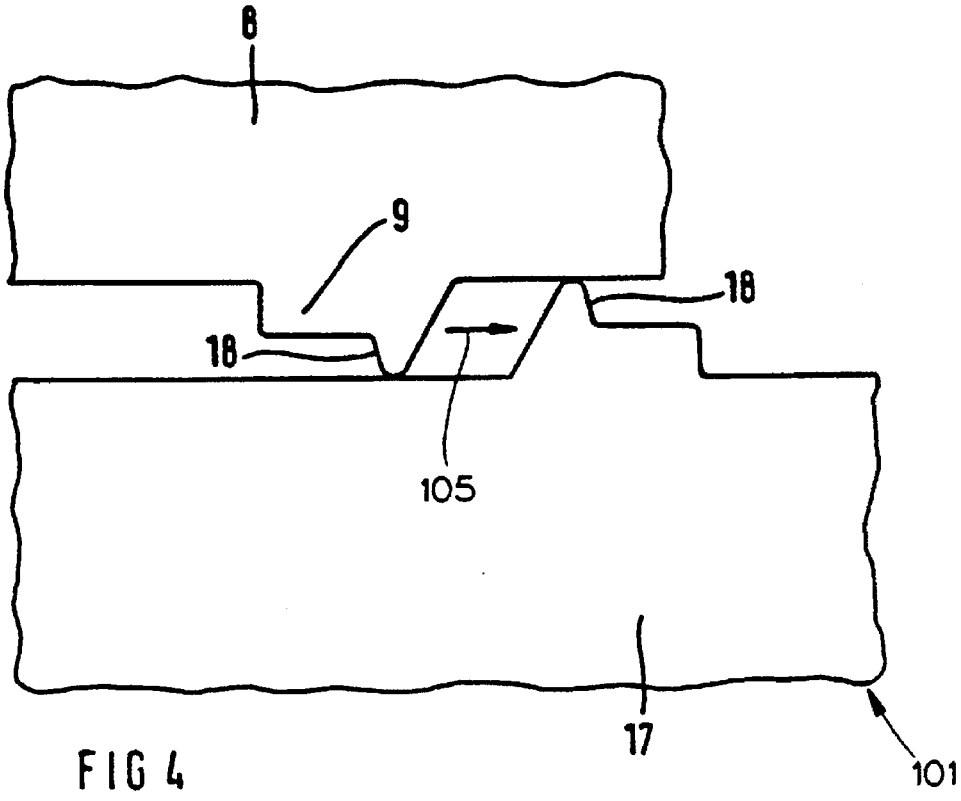
FIG 4
FIG 5
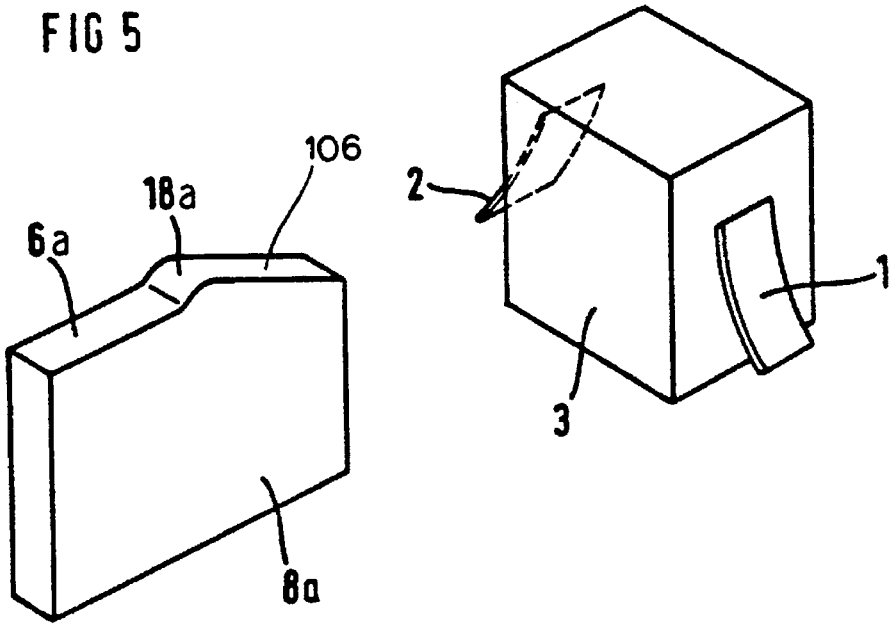

ELECTRICAL PLUG-TYPE CONNECTOR HAVING AN INTERLOCK MECHANISM

BACKGROUND OF THE INVENTION

The present invention is directed to an electrical plug-type connector having a housing with at least one contact chamber for a pluggable contact element, wherein the contact element comprises at least first and second catch tongues that project arrow-like outward opposite to the plug-in direction, the contact chamber having an interlock mechanism for the contact element that defines a primary latching position of the interlock mechanism and the contact element can be introduced unimpeded into the contact chamber.

U.S. Pat. Nos. 4,583,805 and 4,660,915, whose disclosures are incorporated herein by reference thereto and both of which claim priority from German Application 32 47 022, disclose a plug-type connector having a housing with a contact chamber for a pluggable contact element. In order to achieve a durable positional fixing of the inserted contact element in the contact chamber, the known plug-type connector, first, comprises a primary securing means which has the contact element being provided with only one catch tongue that engages behind a stationary catch edge in the contact chamber in the plugged condition. In addition, a plastic frame having interlocking arms that can be brought into engagement with the contact element is provided as a secondary securing means. The frame can be fixed on the housing at the introduction side for the contact element so that the interlock arms are introduced into the contact chamber in the plug-in direction and fix the contact element therein in a clamping fashion.

Plug-type connectors having interlock devices are also commercially obtainable wherein differently fashioned slides that act transversely relative to the plug-in direction are employed. These, however, do not form a movable contact chamber wall, but act in addition to the usual, stationary contact chamber walls. In practice, all known interlock mechanisms exhibit at least one of the following problems.

In many instances, the secondary securing means can be actuated without the primary securing means having been engaged into its provided, ultimate position. The secondary securing element is often only clamped between contact elements and contact chamber walls without engaging behind the contour of the contact. Given secondary securing means provided for that purpose, such an engagement is also not assured with adequate dependability in view of the errors that can occur over and over again in non-automated, manual assembly and in view of the manufacturing tolerances. When the securing occurs only on the basis of the clamping force, then the contact element can be damaged. A dependable electrical contact may not be obtained when, as is possible in many designs, an incorrectly plugged or, respectively, secured contact can be pressed out of the housing when plugging in the blade contacts of the plug-type connector. Given standard contact elements having double-sided catch tongues, moreover, it can easily occur that only a single-sided interlock occurs. Such malfunctions cannot be reliably discovered with known testing methods.

Over and above this, the interlock elements in many solutions are under stress so that in their ultimate position, the retainer elements can no longer spring laterally back after some time after releasing the secondary securing means and disassembly of the contact is, therefore, hardly possible without damage to the device. As a consequence of the more and more compact structure of the plug-type connectors, the space for secondary securing means is becoming more and more constricted so that the integration space for most existing solutions may not be available. Finally, known interlock solutions also present problems in conjunction with water-tight housings and in conjunction with the outlay that is often required in terms of injection molding.

SUMMARY OF THE INVENTION

An object of the present invention is to create a plug-type connector having a housing with at least one contact chamber for a pluggable contact element that is improved with respect to the above-mentioned disadvantages and that, particularly when given a low space requirement, assures a dependable primary and secondary securing even when the contact elements are not properly plugged into the contact chamber.

To accomplish these goals, the invention is directed to an improvement in an electrical plug-type connector having a housing with at least one contact chamber for a pluggable contact element, said contact element having at least a first catch tongue and a second catch tongue that project outwardly arrow-like in a direction opposite the plug-in direction, the connector having an interlock mechanism for defining a primary latching position for the contact element which can be introduced unimpeded into the contact chamber. The improvements are a first contact chamber wall providing a primary catch edge that interacts with the first catch tongue, a second contact chamber wall lying opposite the first chamber wall with a constant spacing therefrom is constructed as a slide movable at least transversely relative to the plug-in direction, the slide comprises a segmented catch edge whose gap extends in the plug-in direction and forms a pass-through possibility for the second catch tongue of the contact element to pass therethrough, and has an interlocked position of both catch tongues as a result of engaging behind the respective catch edges occurring when the interlock mechanism is transferred from an unlatched position to an ultimate latched position by moving the slide.

Other advantages and features of the invention will be readily apparent from the following description of the preferred embodiments, the drawings and claims.

BRIEF DESCRIPTION OF THE DRAWINGS

FIG. 4 is a partial side view of the slide according to FIG. 1;

FIG. 5 is a partial perspective view of a simplified slide embodiment of the plug-type connector;

DESCRIPTION OF THE PREFERRED EMBODIMENTS

Figure 7:
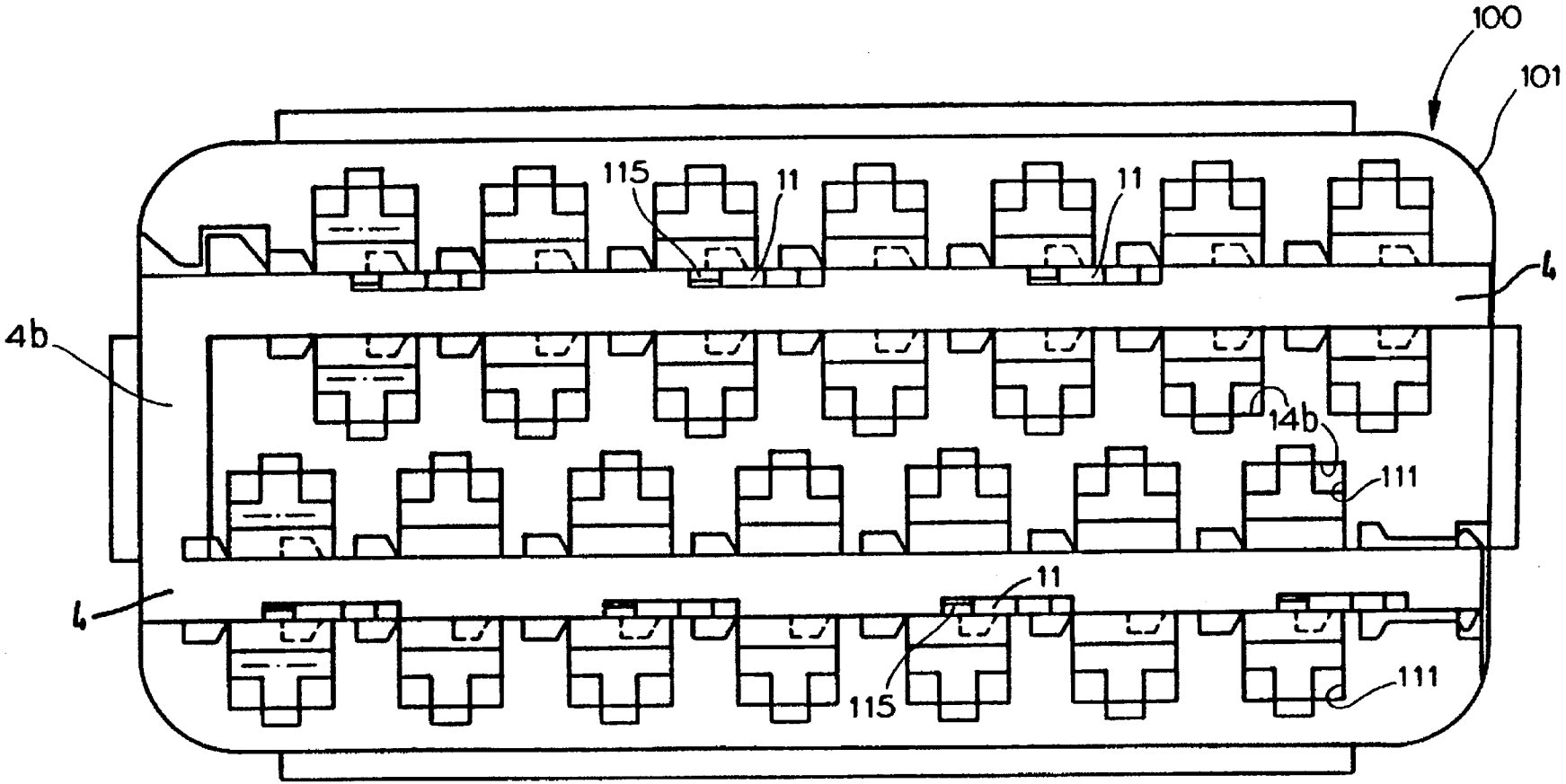
FIG. 7 is a plan view of the contact chambers of a 28-pole plug-type connector of the present invention in its secured condition.

The principles of the present invention are particularly useful when incorporated in a 28-pole plug-type connector, generally indicated at 100 in FIG. 7. The connector 100 has a housing 101 with four rows of contact chambers 111, which are positioned in pairs with a groove extending therebetween for receiving a slide 4. Thus, with the four rows, two slides 4 are provided and, as illustrated, are interconnected together by an arm 4*b* so that the slides can move together in common.

Figure 1:
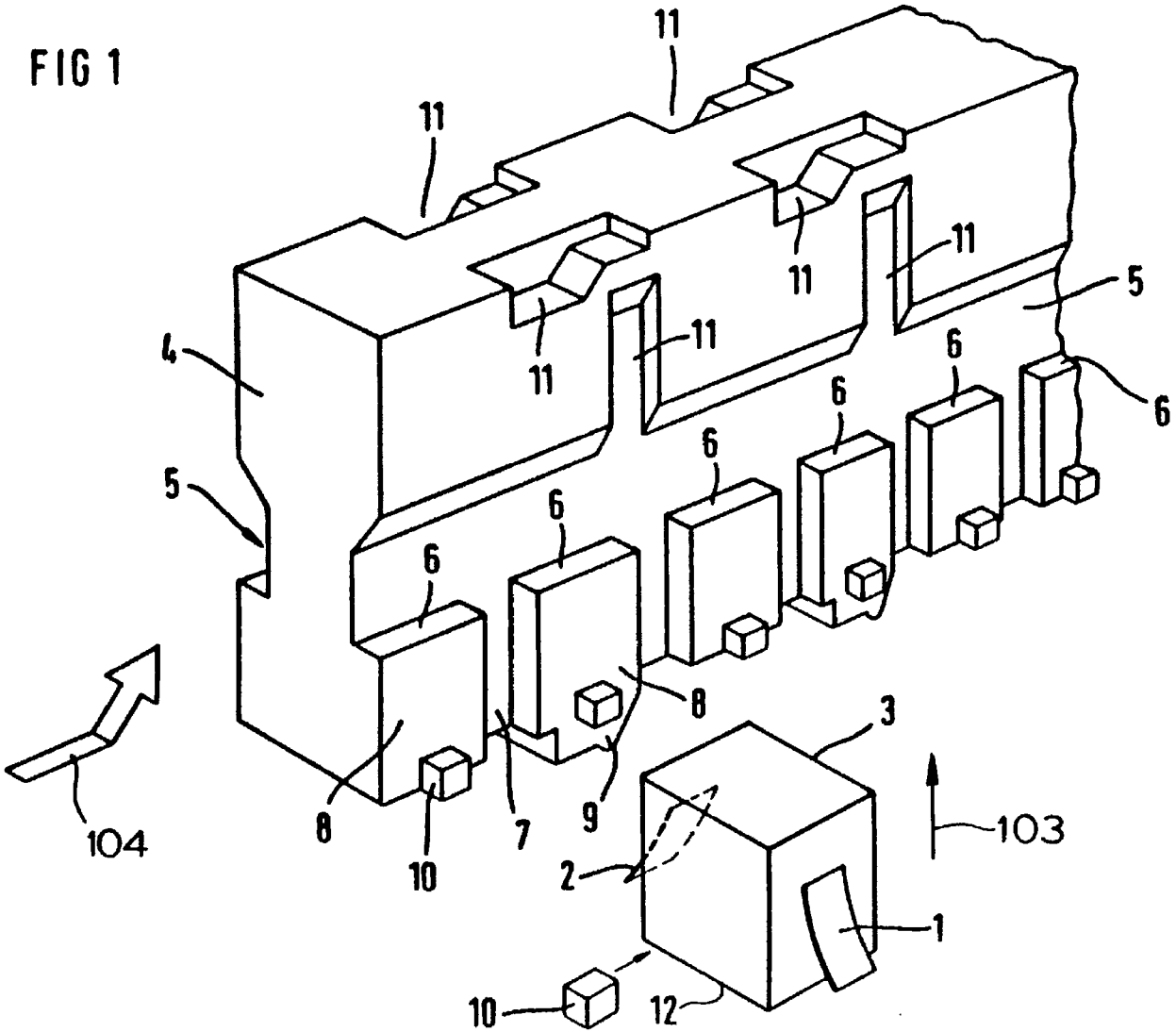
FIG. 1 is a perspective view of a slide of the inventive plug-type connector.

Each of the chambers 111 will receive a contact element 3 which, as illustrated in FIG. 1, has a cube or rectangular prism shape having a lower surface or contour 12 forming a bottom of the prism. On opposite sides, the contact element 3 has two catch tongues 1 and 2 that project outwardly arrow-like opposite a plug-in direction, indicated by an arrow 103. The invention, however, can be applied without further ado to quadratic or round contacts. In the highly schematic illustration of FIG. 1, neither a cable connection possibility in the lower region of the contact element 3 nor the springs that are present in the upper region and which is provided for the acceptance of a pin or blade have been indicated. A stationary first contact chamber wall 14 (FIG. 2) has a primary catch edge 15 which is intended for latching of the first catch tongue 1 (see FIG. 2). The slide 4 shown in FIG. 1 has a side fashioned as a movable or second contact chamber wall 5, whose motion possibility is indicated by an arrow 104 in FIG. 1. This fashioning contributes significantly to the compactness of the plug-type connector. The side or wall 5 has a raised portion divided into segments 8 by gaps 7 having a width which at least corresponds to the width of the catch tongues I and 2. Each segment 8 has an upper surface forming a second catch edge 6 for the second catch tongue 2. The gaps 7 have the function of providing a path or pass-through possibility for the catch tongue 2 facing toward the slide 4 to allow the tongue to pass between the segments 8 to be above the edges 6.

When the contact element 3 has been plugged in, the side thereof from which the catch tongue 2 projects lies between two segments 8 when the slide 4 is in the unlatched position. When the opposite, first catch tongue 1 properly latches at a primary latch edge 15 of a stationary contact chamber wall 14 of the housing 101, this means that the contact element 3 has been pushed up between two segments 8 in a plug-in direction of arrow 103 from the bottom to the top in FIG. 1 so that the catch tongue 2 did not impede the plugging in or, respectively, pushing up of the contact element 3 due to the gap 7 and is now located in a position above the gap 7, particularly above the level of the catch edges 6 as well.

Figure 2:
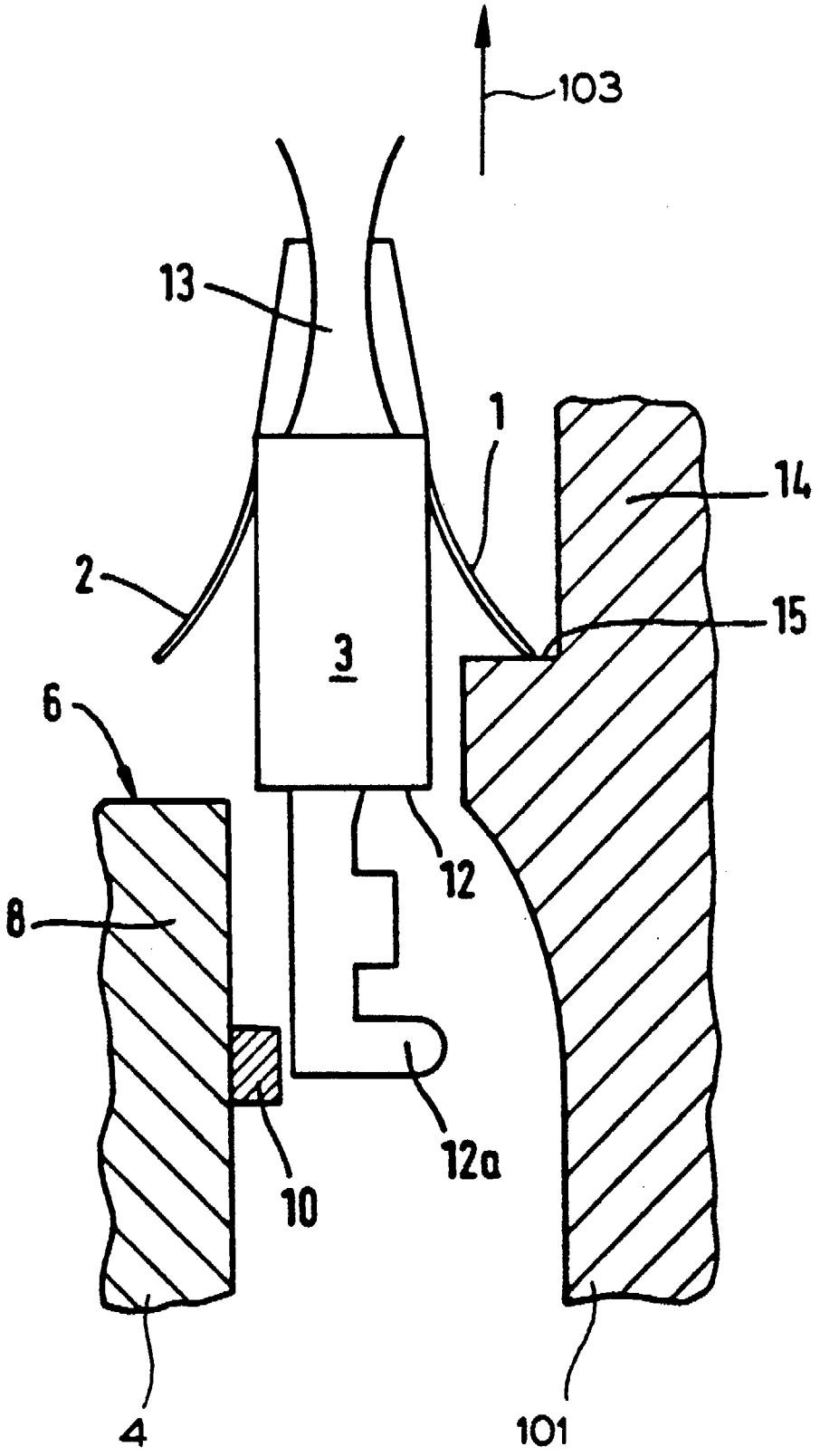
FIG. 2 is a schematic cross sectional view of parts of the plug-type connector.

The functioning of the interlock mechanism is more easily understood by viewing FIG. 1 in combination with FIG. 2. As shown in FIG. 2, a contact element 3 with springs 13 and spring-over contour or base 12, as well as with the crimping terminal 12*a*, is in the ideal primary latched position between the stationary contact chamber wall 14 having the primary catch edge 15 and a segment 8 that belongs to the movable slide 4. The slide is first moved horizontally and is subsequently moved obliquely upward in a path shown by the arrow 104 of FIG. 1. As a result of the horizontal movement of the slide 4, the catch edge 6 on the side of the slide 4 is moved under the free catch tongue 2. Simultaneously, a projecting, additional securing element 10 will be engaged under the spring-over or base 12 of the contact element 3. After obtaining an adequately large attack surface of the catch tongue 2, the slide 4 is guided obliquely up over wedges 9 sliding on top of one another that are arranged in the lower region of the slide 4 and on the floor 17 (see FIG. 4) of the housing 101. The oblique motion thereby advantageously occurs over a spherical cap 18, which is illustrated in FIG. 4, so that the contact element is sure to be lifted above the final latched position. After moving beyond the spherical cap 18, the slide 4 drops slightly down again. As a result thereof, both catch edges 6 and 15 are located at the same level, so that any stresses, such as tensile forces, that may occur are uniformly distributed onto both catch edges 6 and 15, respectively, and onto their respective catch tongues 2 and 1. In addition, the caps 18 form detents to resist or oppose relative movement of the slide 4 and floor 17 in a direction opposite arrow 105.

Figure 3:
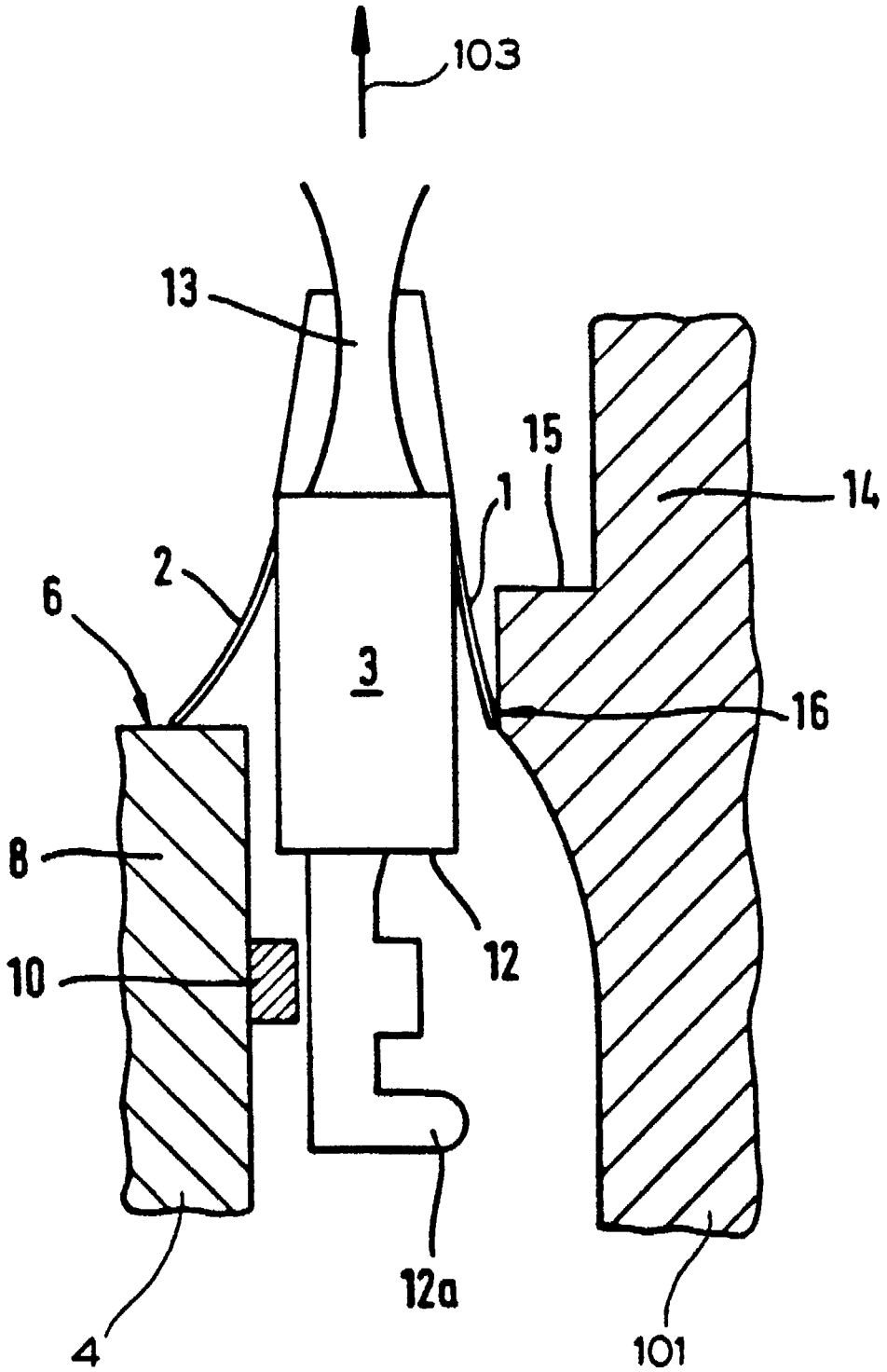
FIG. 3 is a schematic cross sectional view of the parts of the plug-type connector similar to FIG. 2 with the contact element in a different plugged condition.

If the contact element 3 has been incorrectly plugged in and not inserted far enough, as illustrated in FIG. 3, the catch tongue 1 is, therefore, not latched at the primary catch edge 15, but merely presses against a lower wall region 16 in a clamping fashion. In this case, the slide 4 already touches the free catch tongue 2 during the early stage of its motion sequence and pushes the contact element 3 forward in the plug-in direction indicated by arrow 103 until not only the catch tongue 2, but also the catch tongue 1 that assume the secured interlock position in the final latched position, wherein both catch tongues 1 and 2 engage behind their respective catch edges 15 and 6. Given the plug-type connector of the invention, a dependable primary and secondary securing is assured, particularly as a result of the latching of the catch tongues on each side of the element, even when the contact elements are initially not locked in the primary fashion, since the primary and secondary securing interlock positions occur due to the movement of the slide 4. As shown in FIG. 3, the actuation of the secondary securing then by the moving of the slide also reliably pushes the primary securing means established by the primary catch edge 15 and the catch tongue 1 into the final latched position, wherein the two catch edges 15 and 6 lie on one level. Given the contact element that has been plugged into the contact member to an extent even less than that shown in FIG. 3, the lacking primary interlock can be clearly recognized by the blocking of the secondary securing means, since the segments 8 of the slide 4 will press laterally against the catch tongue 2 during the first, initial horizontal motion of the slide 4. Given contact elements that are plugged in an extremely inadequate way, moreover, the faulty assembly of the contact element projecting far from its contact chamber can be easily recognized.

Upon disassembly, the contact element cannot be dismantled until after the secondary securing means has been released, i.e., until after the slide has been pushed back to an initial or starting position, and the primary interlock must also be pressed back with the assistance of a tool, which is usual for these types of devices. This means that the subsequently-mounted contact elements are held in primary and secondary fashion with the same dependability as the initially-mounted contact elements.

A simplified embodiment is illustrated in FIG. 5 and has the plug-type connector of the invention wherein the slide can only be moved transversely relative to the plug-in direction and the possibility of oblique motion is replaced by a segment 8*a* of the catch edge 6*a* that is beveled in the sliding direction to form a ramp 106. Otherwise, the segment 8*a* engages behind the second catch tongue 2 in the way already set forth upon transfer into the initial latching position from forward feed of the contact element 3 in the plug-in direction. It is also advantageous to provide a spherical cap or bump 18*a* at an upper end of the ramp 106 of the segment 8*a*, as shown in FIG. 5. The bump 18*a* will provide a detent to resist unlatching of the tongue 2 from the edge 6*a*.

The invention can be utilized without further ado given standard multi-pole plug-type connectors. When a plurality of contact chambers are arranged next to one another in the housing in only a single row, the slide also need only be fashioned as a second contact chamber wall on one side of the slide. In this case, it is movable between a stationary first contact chamber wall 14 and a housing wall that is parallel thereto. Given a two-row arrangement of the contact elements in the housing, the slide can be fashioned as a second contact chamber wall 5 on both sides, as illustrated in FIG. 1, and is moved between two stationary contact chamber walls 14.

When a plurality of contact chambers are arranged next to one another in the housing in n rows, wherein n>2, the number of slides must amount to at least n/2. A plurality of n+1 slides is meaningful as a maximum. When the plurality of rows is uneven and there are constricted space conditions, it is desirable to construct at least one slide asymmetrically in addition to the above-described symmetrical slide fashioned with a second contact chamber wall on two sides so that at least one asymmetrical slide is to be fashioned with a second contact chamber wall on one side and with a first contact chamber wall with primary catch elements on the opposite side. Such an asymmetrical slide is illustrated by the slide 4*a* in FIG. 6 with a view of the side fashioned as the first contact chamber wall with primary catch edges 15*a*. As shown, it is thereby advantageous to respectively shape the contour of the primary catch edges 15*a* so that an unchanging primary catch edge level is established for the first catch tongue 1 despite the oblique movement of the slide 4*a*. Thus, as the slide moves in the direction of the arrow 107, the primary catch tongue 1 will move from an upper level 15*c* down to the lower level 15*d* of the primary catch edge 15*a*.

As mentioned above, FIG. 7 shows a 28-pole plug-type connector 100 having four rows of contact chambers 111 in a secured condition. Both slides 4 are fashioned with symmetrical sides, wherein the two inwardly disposed rows are separated by two-sided stationary contact chamber walls 14*b*. It is advantageous when, as mentioned above, the two slides, as shown, are interconnected to one another by an arm 4*b* and can thereby be moved in common.

Figure 6:
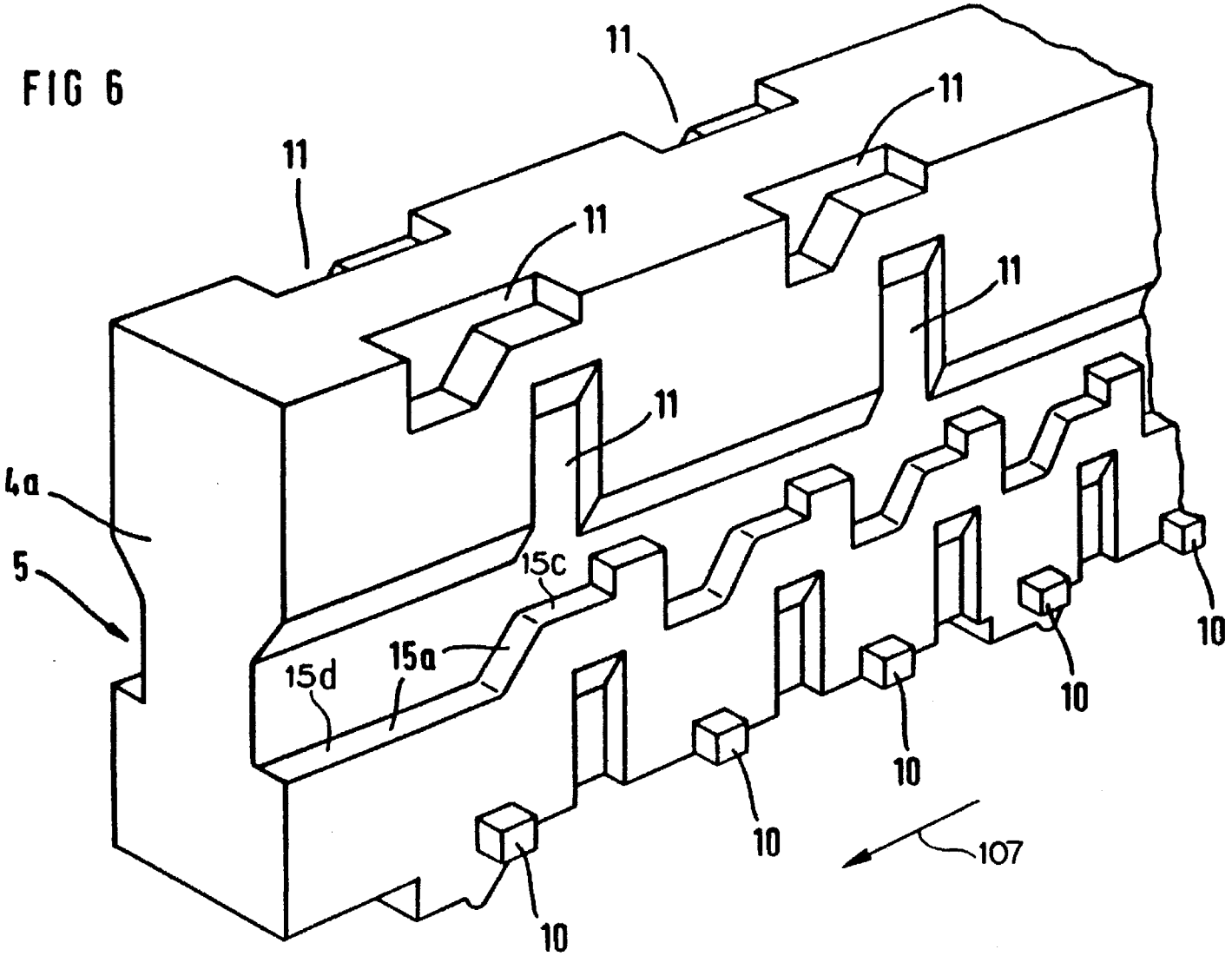
FIG. 6 is a perspective view of another slide embodiment of the plug-type connector.

As may be seen in FIGS. 1 and 6, recesses, such as 11, can be advantageously provided on the tops of the slides. These recesses effect an interlock of the slides in the housing 101 in the final latched position in collaboration with counterpart portions or tabs 115 (FIG. 7) of the housing.

Although various minor modifications may be suggested by those versed in the art, it should be understood that we wish to embody within the scope of the patent granted hereon all such modifications as reasonably and properly come within the scope of our contribution to the art.

We claim:

1. In an electrical plug-type connector having a housing with at least one contact chamber for a pluggable contact element, said contact element having at least a first catch tongue and a second catch tongue that project outwardly arrow-like in the plug-in direction from opposite sides of the contact element, said connector having an interlock mechanism for the contact element for defining a primary latched position and allows the contact element to be introduced unimpeded into the contact chamber, the improvements comprising a first contact chamber wall having a primary catch edge that interacts with the first catch tongue to form a primary securing means, a second contact chamber wall lying opposite the first contact chamber wall at a constant distance therefrom being provided on a slide movable at least transversely relative to the plug-in direction and parallel to the first contact chamber wall between an initial position and a final position, said slide having a segmented catch edge formed by gaps extending in the plug-in direction to form a path for the second catch tongue of the contact element to pass through, said segmented catch edge having a portion forming a second catch edge that interacts with the second catch tongue to form a secondary securing means, means for moving a portion of the second catch edge from a position offset from a plane of the primary catch edge into the plane of the primary catch edge as the slide moves from the initial position to the final position so that a latched position of both catch tongues as a result of engagement behind the respective catch edges occurs upon transfer of the interlock mechanism from an unlatched position to a final latched position by moving the slide from an initial position to a final position.

2. In an electrical plug-type connector according to claim 1, wherein a plurality of contact chambers are arranged side-by-side in one row in the housing, the slide being constructed having the second contact chamber wall on one side and can be moved between a stationary first contact chamber wall and a housing wall extending parallel to the first contact chamber wall.

3. In an electrical plug-type connector according to claim 1, which has a plurality of contact elements being arranged side-by-side in two rows in the housing, the slide being fashioned with the second contact chamber wall on two sides and being movable between two stationary first contact chamber walls.

4. In an electrical plug-type connector according to claim 1, wherein the slide is movable only transversely relative to the plug-in direction and the means for moving a portion of the secondary catch edge has each secondary catch edge being beveled in the sliding direction to provide a ramp for engaging the second catch tongue when transferred into the final latched position to move the catch clement in the plug-in direction.

5. In an electrical plug-type connector according to claim 1, wherein the slide is provided with recesses, said recesses forming an interlock of the slide in the housing in the final latched position by interaction with counterportions of the housing.

6. In an electrical plug-type connector according to claim 1, which includes an additional securing element being supplied on at least one of the segments of the catch edge in the region at the plug side, said additional securing element engaging behind a bottom surface of the contact element when the slide is moved to the final position.

7. In an electrical plug-type connector according to claim 1, which has a plurality of contact elements being arranged side-by-side in n rows in the housing, wherein n>2, and has a plurality of slides with at least one slide of the plurality of slides having the second contact chamber wall on one side and a first contact wall with the primary catch edges on the opposite side and the remaining slides of the plurality of slides having second contact walls on both sides of the slide.

8. In an electrical plug-type connector according to claim 7, wherein the means for moving a portion of the secondary catch edge comprises the slides being simultaneously moved transversely relative to the plug-in direction and with a direction component that coincides with the plug-in direction, whereby at least one segment of the catch element engages behind the secondary catch tongue on the basis of said slanting motion to transfer the catch element into the final latched position upon forward feed of the contact element in the plug-in direction, and wherein the slide having one side as a first contact chamber wall with the primary catch edges, the contour of the primary catch edges arc respectively shaped so that despite the slanting motion of the slide, an unchanging level for the primary catch edge is established for the first catch tongue.

9. In an electrical plug-type connector according to claim 1, wherein the means for moving a portion of the secondary catch edge comprises the slide being simultaneously moved transversely relative to the plug-in direction and with a directional component that coincides with said plug-in direction.

10. In an electrical plug-type connector according to claim 9, wherein the slanting motion of the slide occurs from a coaction of wedges on the slide with wedges on the housing.

11. In an electrical plug-type connector according to claim 10, wherein a contour of the wedges on at least one catch element segment of the slide is fashioned so that during movement of the slide from the initial position to the final position the slide has a transverse motion followed by the slanting motion.

12. In an electrical plug-type connector according to claim 11, wherein the contour is additionally provided with a spherical cap which is positioned at the end of the portion of the wedge causing the slanting motion.

13. In an electrical plug-type connector having a housing with at least one contact chamber for a pluggable contact element, said contact element having at least a first catch tongue and a second catch tongue that project outwardly arrow-like in the plug-in direction, said connector having an interlock mechanism for the contact element for defining a primary latched position and allows the contact element to be introduced unimpeded into the contact chamber, the improvements comprising a first contact chamber wall having a primary catch edge that interacts with the first catch tongue, a second contact chamber wall lying opposite the first contact chamber wall at a constant distance therefrom being provided on a slide movable at least transversely relative to the plug-in direction, said slide having a segmented catch edge formed by gaps extending in the plug-in direction to form a path for the second catch tongue of the contact element to pass through, and an additional securing element being supplied on at least one of the segments of the catch edge in the region at the plug side, said additional securing element engaging behind a bottom surface of the contact element when the slide is moved to a final position, so that a latched position of both catch tongues as a result of engagement behind the respective catch edges occurs upon transfer of the interlock mechanism from an unlatched position to a final latched position by moving the slide from an initial position to the final position.

* * * * *